US007844208B2

(12) United States Patent
Hayashi et al.

(10) Patent No.: US 7,844,208 B2
(45) Date of Patent: Nov. 30, 2010

(54) IMAGE HEATING APPARATUS

(75) Inventors: Yasuhiro Hayashi, Moriya (JP); Shigeaki Takada, Kashiwa (JP); Daigo Matsuura, Toride (JP); Ikuo Nakamoto, Toride (JP); Kazuhiro Hasegawa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 643 days.

(21) Appl. No.: 11/695,233

(22) Filed: Apr. 2, 2007

(65) Prior Publication Data

US 2007/0231026 A1 Oct. 4, 2007

(30) Foreign Application Priority Data

Mar. 31, 2006 (JP) ..... 2006-098919

(51) Int. Cl.
*G03G 15/20* (2006.01)

(52) U.S. Cl. ..... 399/329

(58) Field of Classification Search ..... 399/328, 399/329, 327, 324, 325; 219/216
See application file for complete search history.

(56) References Cited

U.S. PATENT DOCUMENTS

| | | | | |
|---|---|---|---|---|
| 6,733,944 | B2 * | 5/2004 | Kadokura et al. | |
| 7,200,354 | B2 | 4/2007 | Nakamoto et al. | 399/329 |
| 7,263,306 | B2 | 8/2007 | Hayashi | 399/70 |
| 2004/0131401 | A1 * | 7/2004 | Nakatogawa et al. | 399/328 |
| 2005/0185996 | A1 * | 8/2005 | Oishi et al. | 399/329 |
| 2006/0083562 | A1 * | 4/2006 | Matsumoto et al. | 399/329 |
| 2006/0127142 | A1 | 6/2006 | Nakamoto et al. | 399/329 |
| 2006/0216077 | A1 * | 9/2006 | Komuro | 399/328 |
| 2007/0059065 | A1 | 3/2007 | Takada et al. | 399/329 |
| 2007/0127958 | A1 | 6/2007 | Matsuura et al. | 399/328 |
| 2007/0140760 | A1 | 6/2007 | Nakamoto et al. | 399/329 |
| 2007/0223979 | A1 | 9/2007 | Jinzai et al. | 399/333 |

FOREIGN PATENT DOCUMENTS

| | | | |
|---|---|---|---|
| JP | 2002148970 | A * | 5/2002 |
| JP | 2002-372881 | | 12/2002 |
| JP | 2005-300983 | | 10/2005 |
| JP | 2007079183 | A * | 3/2007 |

OTHER PUBLICATIONS

English Translation of JP 2005300983A.*

* cited by examiner

*Primary Examiner*—David P Porta
*Assistant Examiner*—Milton Gonzalez
(74) *Attorney, Agent, or Firm*—Fitzpatrick, Cella, Harper & Scinto

(57) ABSTRACT

An image heating apparatus includes an endless belt for heating an image on a recording material in a nip and a pressing pad for pressing the belt from an inner surface thereof in the nip. A sheet-like member is provided to cover the pressing pad, providing for sliding movement relative to the belt. A lubricant absorbing member for suppressing swelling of the pressing pad by absorbing a lubricant applied on an inner surface of the belt, with the lubricant absorbing member covered by the sheet-like member.

11 Claims, 6 Drawing Sheets

IMAGE HEATING APPARATUS

FIELD OF THE INVENTION

The present invention relates to an image heating device which heats an image on a recording material. As such an image heating device, there are, for example, a fixing device for fixing an unfixed image on a recording material, a glossiness enhancing device for increasing a glossiness of the image by heating an image fixed on a recording material, and so on. Such an image heating device is used in an image forming apparatus that uses an electrophotographic type process, for example, a copying machine, a printer, and a facsimile machine.

DESCRIPTION OF RELATED ART

Heretofore, in the image forming apparatus which employs an electrophotographic type process, the various types of fixing devices are proposed for heating, fusing, and fixing the unfixed toner image formed and carried on the recording material. As an example of one of such fixing device, a belt type image fixing device wherein an endless belt is press-contacted to a fixing roller by a pressing pad is disclosed in Japanese Laid-open Patent Application 2005-300983.

In this fixing device, width of a belt nip formed with the fixing roller and the endless belt can be easily enlarged beyond a nip width between the conventional fixing roller and pressing roller, and therefore, adaptation to improve the speed is possible, and it is also easy to accomplish downsizing of the device.

In such a belt type image fixing device, a structure wherein the pressing pad press-contacts the endless belt to the fixing roller is employed, and therefore, sliding friction exists between the pressing pad and the belt. Therefore, in the fixing device disclosed in Japanese Laid-open Patent Application 2005-300983, improvement of the sliding property between the low-frictional sheet and the belt is expected by disposing a low-frictional sheet on the pressing pad, and applying a lubricant on an inner surface of the belt.

However, between the pressing pad and the belt, a pressure is applied, and therefore, the force is applied which pushes out the lubricant supplied to the inner surface of the belt, and the leakage of lubricant tends to occur from opposite ends of the belt. As a result, the lubricant applied on the inner surface of the belt spreads to an inner surface of the low-frictional sheet and reaches the pressing pad, thus, there is a possibility that a rubber portion of the pressing pad may swell with lubricant. In this way, if the pressing pad swells, the pressure of the fixing nip varies away from a proper value, resulting in a poor fixing property.

In order to solve such a problem, a lubricant wiping out member for wiping off lubricant is provided in contact with the end of an inner surface of the belt in the belt type image fixing device described in Japanese Laid-open Patent Application 2002-372881.

However, the lubricant wiping out member absorbs lubricant and lubricant absorbing capacity or absorptance thereof will be lost at an early stage, since this lubricant wiping out member is not covered with the low-frictional sheet. Therefore, there is a possibility that it may become impossible for the lubricant wiping out member to achieve the intended function thereof, and the pressing pad may swell with lubricant as a result.

SUMMARY OF THE INVENTION

Accordingly, it is a principal object of the present invention to provide an image heating device that can suppress the phenomenon in which a pressing pad swells with a lubricant.

According to an aspect of the present invention, there is provided an image heating apparatus comprising an endless belt for heating an image on a recording material in a nip; a pressing pad for pressing said belt from an inner surface thereof in said nip; a sheet-like member, provided to cover said pressing pad, for sliding movement relative to said belt; a lubricant absorbing member for suppressing swelling of said pressing pad by absorbing a lubricant applied on an inner surface of said belt, said lubricant absorbing member is covered by said sheet-like member.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

The preferred embodiments of the present invention will be described in conjunction with accompanying drawings. Although the embodiment is an example of the best mode of the present invention, the present invention is not limited to the embodiment.

(1) Example of Image Forming Apparatus

Figure 1:
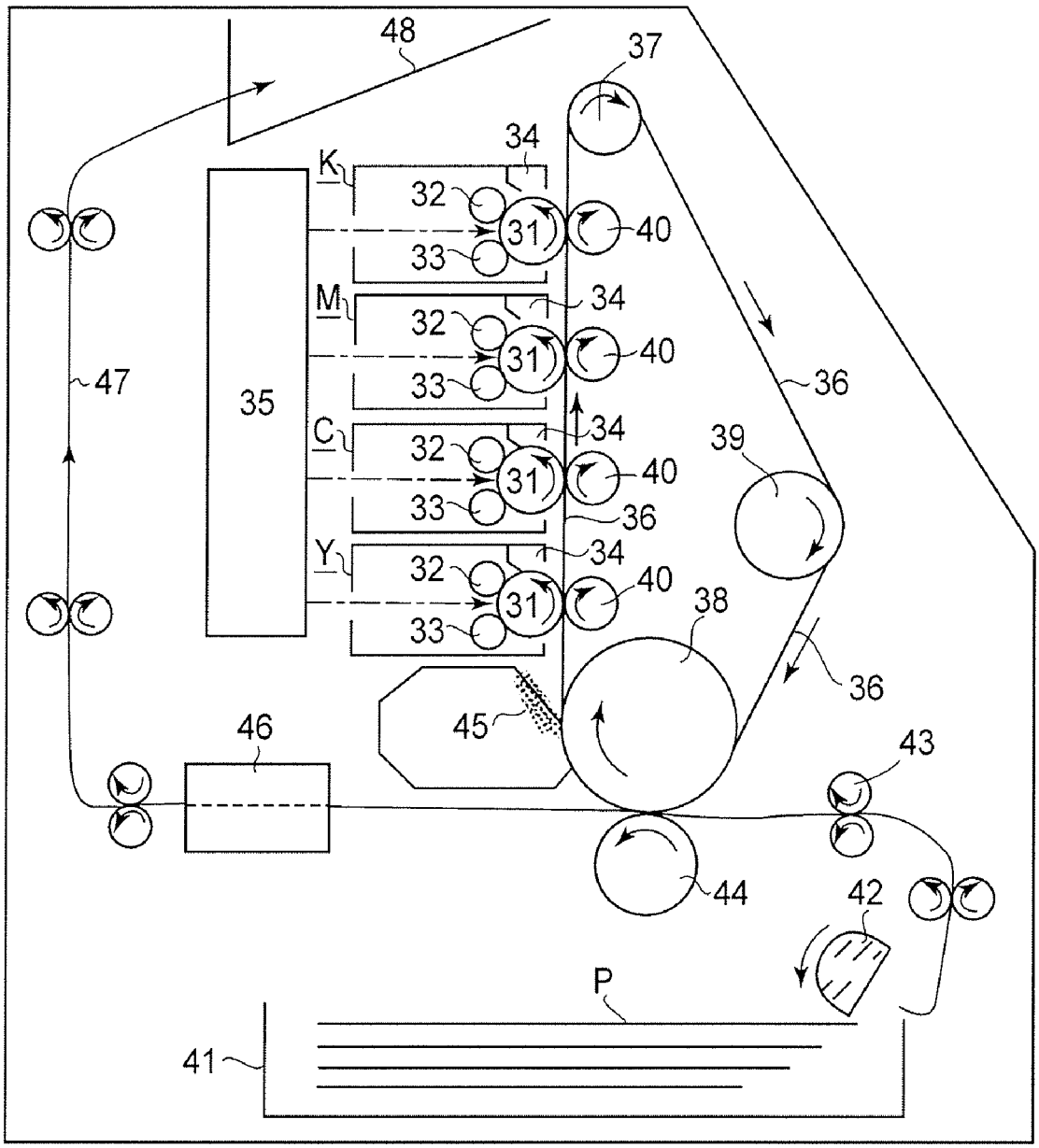
FIG. 1 illustrates a general arrangement of an example of an image forming apparatus.

FIG. 1 is a general arrangement of the example of an image forming apparatus. The image forming apparatus of this example uses an electrophotographic process, and forms a full-color image.

Designated by Y, C, M, and K are the electrophotographic image forming stations which form the yellow, cyan, magenta, and black color toner images, respectively, and the image forming stations are arranged in this order from the bottom to the top. Each image forming station is provided with an electrophotographic photosensitive member drum (hereafter called the drum) 31, a charger 32, a developing device 33, a cleaning device 34, and so on. An optical system 35 for forming an electrostatic latent image by exposing the drum 31 of each image forming station Y, C, M, and K with the image light is provided. In this embodiment, the optical system 35 is a laser scanning exposure optical system.

In each image forming station Y, C, M, and K, the drum 31 is rotated in the clockwise direction indicated by an arrow, at a predetermined speed, during which it is uniformly charged by the charger 32. The drum 31 is exposed to the scanning image light on the basis of the image data from the optical system 35. By this, the electrostatic latent image corresponding to the scanning image light is formed on the surface of the drum. The electrostatic latent image thereof is developed into a toner image by the developing device 33. In other words, a yellow toner image is formed on the drum 31 of a yellow image forming station Y, and a cyan toner image is formed on the drum 31 of a cyan image forming station C. In addition, a magenta toner image is formed on the drum 31 of a magenta image forming station M, and a black toner image is formed on the drum 31 of a black image forming station K.

The color toner images formed on the drums of the image forming stations Y, C, M, K are superimposedly transferred in order in the state of predetermined position doubling onto an intermediary transfer belt 36 hereafter called primary transferring, which is rotated in the clockwise direction indicated by an arrow at substantially the same speed as the drum in synchronism with the rotation of the corresponding drum. By this, the full-color toner image is formed in composition on the belt 36. The primary transferring of the toner image onto the belt 36 is effected from each drum 31 by applying a primary transferring bias, having the polarity opposite to that of the toner, to the primary transfer roller 40 of each image forming station Y, C, M, and K from an unshown bias voltage source. The toner which remains on each drum after the transferring is removed by a cleaning device 34.

The belt 36 is extended and stretched around three rollers, namely, a driving roller 37, a secondary transfer roller opposition roller 38, and a tension roller 39, and the belt is driven by the driving roller 37.

On the other hand, by a feeding roller 42, the recording material (transferring material) P contained in a sheet paper cassette 41 is separated one by one, and is fed out. The recording material P thereof is fed to a nip between the belt 36 portion extended around by the secondary transfer roller opposition roller 38 and the secondary transfer roller 44 by the registration rollers 43 at the predetermined controlled timing. The primary transferring toner image formed on the belt 36 is transferred all together, onto the recording material P by the bias having the polarity opposite to that of the toner applied to the secondary transfer roller 44 and supplied from an unshown bias application means. The toner which remains on the belt 36 after the secondary transfer is removed by an intermediary transfer belt cleaning device 45.

The recording material P that now carries the toner image is separated from the belt 36, and it is introduced into the fixing device 46, which is the image heating device, where it is subjected to fixing processing of the toner image. The recording material P thereof is fed to a sheet discharge tray 48 through a delivery path 47.

(2) Fixing Device 46

Figure 2:
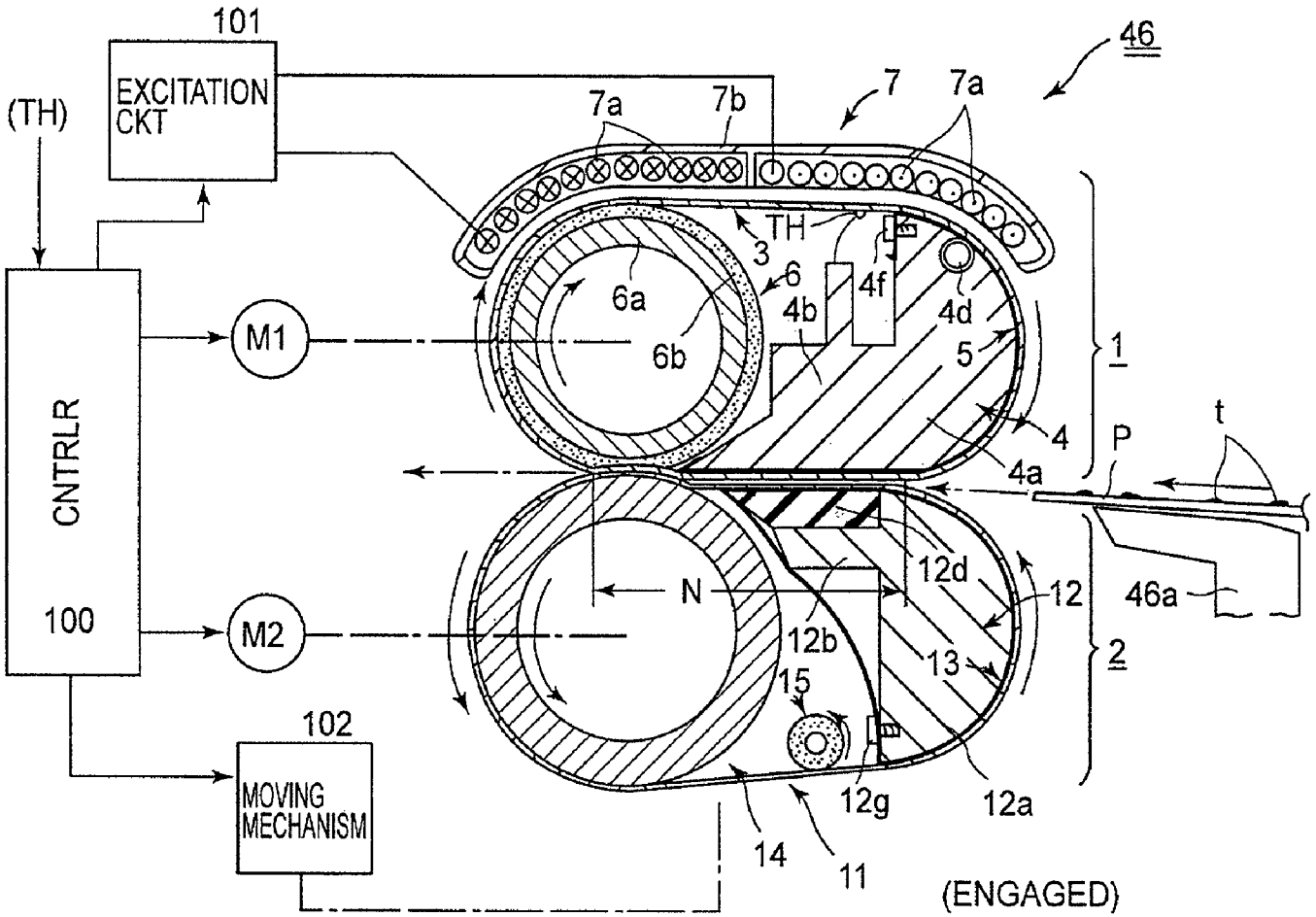
FIG. 2 is an enlarged sectional view of a major part and a block diagram of a control system of a fixing device.

FIG. 2 is an enlarged sectional view showing the major part of the fixing device 46 as the image heating device, and a block diagram of a control system for it. This fixing device 46 is a device of an electromagnetic induction heating type and a belt nip type.

Here, in the following descriptions, with respect to the fixing device or the members which constitute the fixing device, the front side is the surface as seen from the recording material entrance side, and the right and left are right and left as seen from the front side. The widthwise direction or width is the direction parallel with the direction which is perpendicular to the sheet feeding direction with respect to the surface of the sheet passage, or the dimension measured in the widthwise direction. The upstream and downstream is upstream and downstream with respect to the sheet feeding direction.

This fixing device 46 comprises a fixing belt unit 1 and a pressing belt unit 2 which are disposed one above the other. The units 1 and 2 are press-contacted to each other, and a press-contacting portion (fixing nip) N is formed between the fixing belt 3, of the unit 1, and the pressing belt 11 of the unit 2. The recording material P which carries an unfixed toner image t is introduced into this press-contacting portion N, and it is nipped and fed, so that the unfixed toner image t is formed on the surface of the recording material P as a permanent fixed image heat-and-pressure fixing.

The fixing belt unit 1 comprises a flexible endless fixing belt 3 as a heating rotatable member, a fixing belt guide member 4 as a pressing member, a guide cover 5 as a low-frictional sheet-like member, a fixing roller 6, a coil assembly 7 for heating the fixing belt 3, and so on.

The guide member 4 is supported non-rotationally between the right and left side plates of the frame (unshown) of the unit 1.

The cover 5 is provided on the guide member 4 so as to cover such a side of the guiding member 4 that is opposed to the inner side of the fixing belt 3 in order to reduce the frictional resistance between the guiding member 4 and the fixing belt 3. The fixing roller 6 is arranged in parallel with the guide member 4 on the downstream side of the guide member 4, and it is rotatably supported between the right and left side plates of the unit frame. The fixing belt 3 is stretched between the guide member 4 and the fixing roller 6. The coil assembly 7 is a heater (the heating source) which carries out induction heating of the fixing belt 3, and it is supported between the left and right side plates of the unit frame so that it opposes to the upper surface of the fixing belt 3.

The pressing belt unit 2 includes a flexible endless pressing belt 11 as a heating rotatable member, a pressing belt guide member 12 as a pressing member, a guide cover 13 as the low-frictional sheet-like member (protection sheet), a pressing roller 14, an oil application roller 15 as the lubricant application means, and so on.

The guide member 12 is supported non-rotationally between the right and left side plates of the frame (unshown) of the unit 2.

The cover 13 is provided on the guide member 12 so as to cover a side of the guiding member 12 that is opposed to the inner side of the pressing belt 11 in order to reduce the frictional resistance between the guiding member 12 and the pressing belt 11. The pressing roller 14 is arranged in parallel with the guide member 12 downstream of the guide member 12, and it is rotatably supported between the left and right side plates of the unit frame. The pressing belt 11 is stretched between above described guide member 12 and pressing roller 14. The oil application roller 15 applies silicone oil as a lubricant on an inner surface of the pressing belt 11 in order to reduce a frictional resistance between the pressing belt 11 and the cover 13. This roller 15 is contacted to the inner surface of the pressing belt 11, and is rotatably supported between the right and left side plates of the unit frame.

1) Fixing Belt 3

Figure 3:
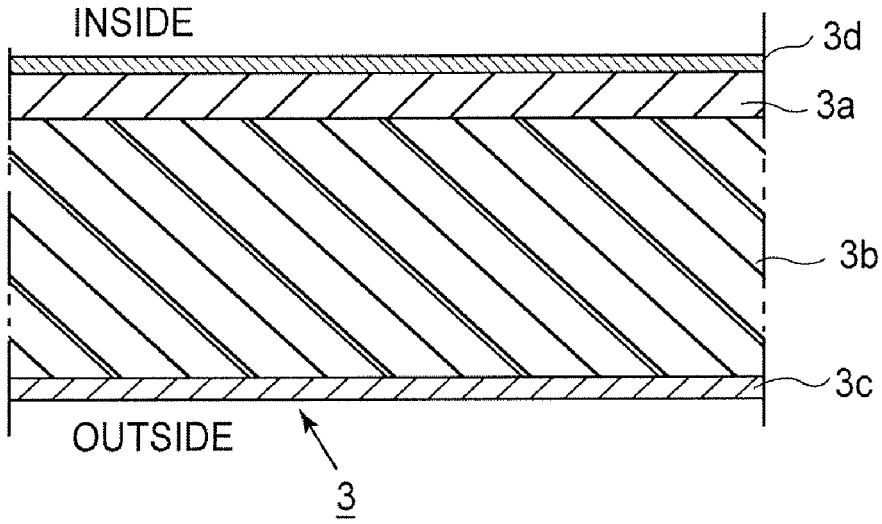
FIG. 3 illustrates a layer structure of a fixing belt.

FIG. 3 illustrates a layer structure of the fixing belt 3. In this embodiment, the fixing belt 3 is manufactured by the electroforming method, and, it comprises the flexible base layer made from nickel 3*a*, which is 34 mm in inner diameter and is 75 μm in thickness. A heat-resistive silicone rubber layer is formed on the outer periphery of the base layer 3*a* as an elastic layer 3*b*. As for the thickness of the rubber layer, it is preferable that it is within the range of 100-1000 μm. In order to shorten the warming-up time by making thermal capacity of the fixing belt 3 small and in order to provide suitable images in fixing color images, the rubber layer comprises the thickness of approximately 400 μm, in this embodiment. The silicone rubber has a hardness of JIS-A20 degrees, and a thermal conductivity of approximately 0.8 W/mK. On the outer periphery of the elastic layer 3*b*, a fluororesin layer (for example, PFA and PTFE) is provided, which has a thickness of 30 μm as a surface parting layer 3*c*. on the inner surface of the base layer 3*a*, in order to reduce the sliding friction relative to the inside member of the fixing belt, a resin material layers having a thickness of 30 μm, such as the fluororesin and the polyimide, may be provided as a lubricative layer 3*d*. In this embodiment, the polyimide layer of 14-μm thickness is provided as a lubricative layer 3*d*.

The material of the base layer 3*a* can be suitably selected from other metal layers, such as ferrous metal, copper, silver, in addition to a nickel layer. These metal layers may be laminated on the resin material base layer. The thickness of the metal layer may be adjusted properly by one skilled in art in accordance with the frequency of the high frequency current which is applied to the coil assembly 7, which will be described hereinafter the thickness of the metal layer may also be adjusted in accordance with the permeability and conductivity of the metal layer. The thickness is preferably about 5-200 μm.

2) Fixing Belt Guide Member 4 and Guide Cover 5

Figure 4:
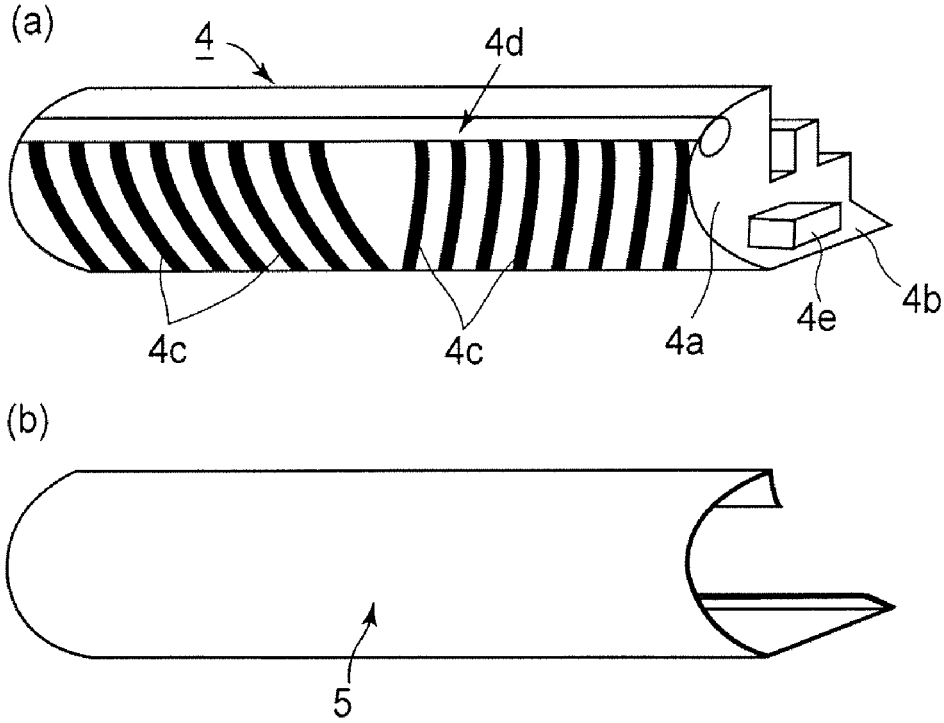
FIG. 4 illustrates a perspective view of an outer appearance of a fixing belt guide member (a), and a perspective view of an outer appearance of a guide cover.

In FIG. 4, (a) is an outer appearance perspective view of the fixing belt guide member 4, and (b) is an outer appearance perspective view of a guide cover 5. The guide member 4 is the resin material and, in this embodiment, is PPS. A fixing belt supporting portion 4*a* of the guide member 4 has a substantially semicircle column configuration. In order to prevent a pressure void in the press-contacting portion N, the guide member 4 is provided with an overhanging extension extending to a position as close as possible to the fixing roller 6. The portion of the guide member 4 which contacts the inner surface of the fixing belt 3 is provided with two or more ribs 4*c* extending in a moving direction of the fixing belt with clearances along the widthwise direction (the longitudinal direction of the member per se). The ribs 4*c* are provided in order to reduce area that the guide member 4 contacts to the inner surface of the fixing belt 3 through the cover 5 and to reduce frictional resistance. The ribs 4*c* also function to reduce conduction of the heat from the fixing belt 3 to the guide member 4, so that the fixing belt 3 is efficiently maintained at the high temperature. However, at the press-contacting portion N, in order to press the fixing belt 3 and the pressing belt 11 to each other, the rib is not provided on the surface of the overhang extension portion 4*b*. In order to provide a uniform temperature distribution of the fixing belt 3 in the widthwise direction, a heat pipe 4*d* extended along the widthwise direction is provided in the guide member 4. The guide member 4 is provided with projections 4*e* on the right and left opposite ends, respectively, and is supported between the right and left side plates by the projections engaging with the engaging portions of the side plates. The guide member 4 also functions as the tension member for the fixing belt 3, and, in this embodiment, it gives a tension of 49N (5 kgf) to the fixing belt 3.

The cover 5 is a lubricative sheet-like member for reducing the frictional resistance between the fixing belt 3 and the guide member 4, and it is provided on the guide member 4 so that the opposition surface of the guide member 4 relative to the inner surface of the fixing belt is covered. The coefficient of friction of the cover 5 relative to the inner surface of the fixing belt is smaller than the coefficient of friction relative to the guide member 4, and it is preferably is cloth made from glass fiber coated with the fluororesin or a sheet-like polyimide. In this embodiment, the latter sheet-like polyimide is employed. The cover 5 is fixed on the guide member 4 by the screw 4*f* in the fixing belt rotational direction upstream section of the guide member 4, so that the opposition surface of the guide member 4 relative to the inner surface of the fixing belt is covered.

3) Fixing Roller 6

In this embodiment, the fixing roller 6 comprises a core metal 6*a* and an elastic layer 6*b* provided on the outer periphery surface thereof, and it is an elastic roller with an outer diameter of 20 mm. The diameter at the widthwisely central portion (the longitudinally central portion) of the core metal 6*a* is 18.5 mm, and the diameters of the opposite ends thereof are 18 mm, wherein it is a product made fromferrous metal which comprises a crown configuration. The elastic layer 6*b* is made of a silicone rubber layer in order to reduce the heat conduction from the fixing belt 3 by making thermal conductivity of the fixing roller 6 small. The hardness in the widthwisely central portion of the fixing roller 6 is about 60 degrees in the hardness meter ASK-C. The core metal 6*a* has a taper configuration, whereby, even if the fixing roller 6 flexes in pressing, the width, with respect to the direction of the belt movement, of the press-contacting portion relative to the pressing roller 11 is made uniform over the longitudinal direction of the press-contacting portion.

The fixing roller 6 is rotated in the clockwise direction indicated by arrow in FIG. 2 by receiving the driving force of the motor M1 controlled in the controlling circuit 100 through the drive transfer system (unshown) at a predetermined speed. The rotation of the fixing roller 6/the fixing belt 3 by which the extension-around stretching is carried out between the fixing roller 6 and the guide member 4. The fixing roller 6 rotates in the clockwise direction indicated by an arrow by the friction between the silicone rubber layer 6*b* of the outer surface of the fixing roller 6 and the polyimide layer 3*d* of the inner surface of the fixing belt 3. Therefore, in order to drive the fixing belt 3 without the slip it is preferable that the friction between the inner surface of the fixing belt 3 and the fixing roller 6 is large. The sliding friction between the guide member 4 and the fixing belt 3 is small by provision of the cover 5, and therefore, the fixing belt 3 can be rotated stably without slipping.

4) Coil Assembly 7

The coil assembly 7 as a heater of the fixing belt 3 comprises an induction heating coil 7*a* and a magnetic material core 7*b* that covers the coil 7*a* so that the magnetic field produced with the coil 7*a* may not leak except for the metal layer 3*a* of the fixing belt 3. Further, the coil 7*a* and the core 7*b* are integrally molded with an electrically insulative resin material. The fixing belt 3 and the coil 7*a* are set to a state of electric insulation by the 1.5-mm-thick mold. The clearance between the fixing belt 3 and the coil 7*a* is constant at 2.5 mm (the distance of the surface of the mold and the surface of the fixing belt is 1.0 mm), so that the fixing belt 3 is heated uniformly. A length of the coil 7*a* measured along the widthwise direction (the direction perpendicular to in the feeding direction of the recording material P) of the recording material P is determined so it is larger than the sheet passing width of the recording material P of maximum sheet passing width in which image formation is carried out. In the state where the fixing belt 3 is rotated, the 20-50 kHz high frequency current is applied to the coil 7*a* from the excitation circuit 101. By this, the induction heat generation occurs in the metal layer 3*a* of the fixing belt 3, and therefore, the fixing belt 3 is heated. A temperature of the fixing belt 3 is sensed by the temperature sensor TH elasticly contacted to the inner surface of the fixing belt 3. The electrical information concerning the temperature of the fixing belt sensed by the temperature sensor TH is inputted to the controlling circuit 100. The controlling circuit 100 controls the electric power inputted to the coil 7*a* by changing the frequency of the high frequency current from the excitation circuit 101 to the coil 7*a* based on the inputting temperature data so that the control is effected such that the fixing belt temperature sensed by the temperature sensor TH is constant at the target temperature (for example 170 degrees C.).

5) Pressing Belts 11

Figure 5:
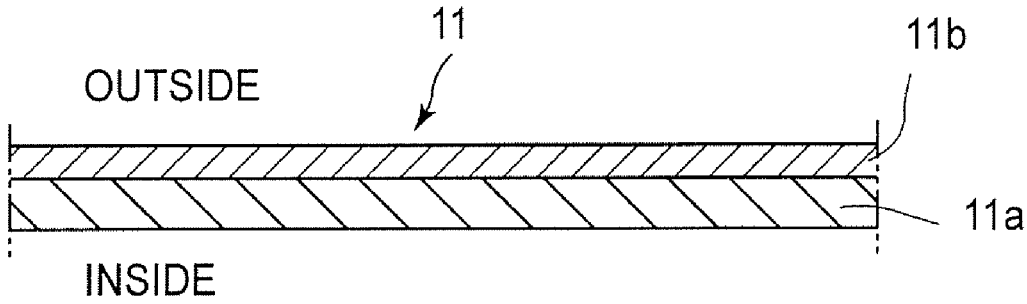
FIG. 5 illustrates a layer structure of a pressing belt.

FIG. 5 is a schematic view of a layer structure of the pressing belt 11. In this embodiment, the pressing belt 11 comprises the base layer 11*a*, which is an endless polyimide belt with flexibility, and which comprises an inner diameter of 34 mm and 50 μm in thickness. A tube of a fluororesin PFA having a thickness of 30 μm is provided as the parting layer 11*b* on the outer periphery surface of the base layer 11*a*. In order to reduce the sliding friction relative to the guide cover 13, it is preferable to disperse fine particles of fluororesin in the polyimide belt which is the base layer 11*a*.

6) Pressing Belt Guide Member 12, Guide Cover 13, Oil Application Roller 15

Figure 6:
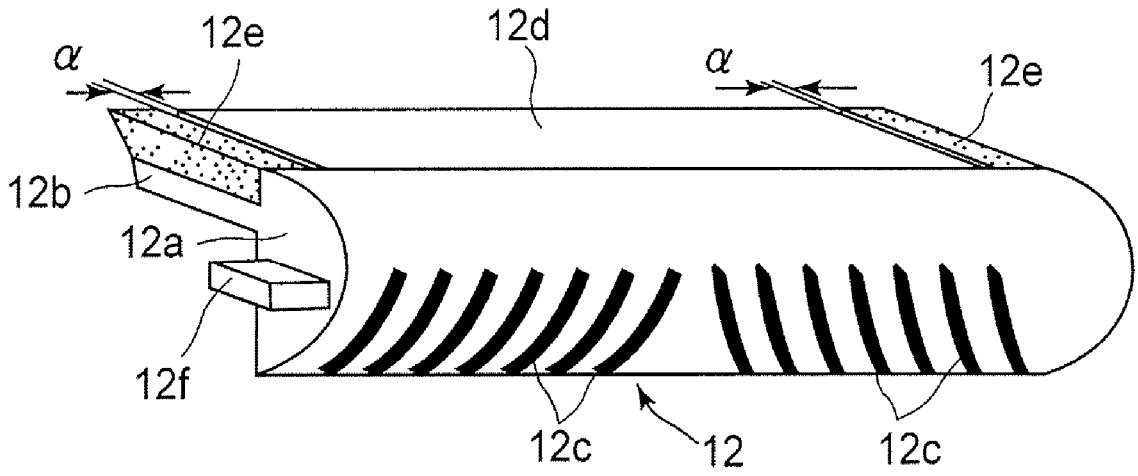
FIG. 6 is an outer appearance perspective view of a pressing belt guide member.

FIG. 6 is an outer appearance perspective view of the pressing belt guide member 12. The guide member 12 is a resin molding and in this embodiment is made from PPS. The pressing belt supporting portion 12*a* of the guide member 12 is substantially semicircle-like. The guide member 12 is provided with an overhanging extension 12*b* extending to a position as close as possible to the pressing roller 14 in the press-contacting portion N, in order to prevent occurrence of the pressure void in the press-contacting portion N.

In order to enhance the close-contact between the fixing belt 3 and the pressing belt 11 in the press-contacting portion N, the opposition surface side of the overhanging extension 12*b* opposed to the pressing belt is an elastic member portion 12*d* functioning as a pressing pad.

In this embodiment, a silicone rubber plate is bonded to the overhanging extension (base member) 12*b* of the guide member 12 to constitute the pressing pad 12*d*. The portion of the guide member 12 which contacts the inner surface of the pressing belt 11 is provided with two or more ribs 12*c* extended in a moving direction of the pressing belt with clearances along the widthwise direction. The rib 12*c* is effective to reduce area which the guide member 12 contacts to the inner surface of the pressing belt 11 interposing the cover 13 therebetween so that the frictional resistance is reduced. However, in order to press the pressing belt 11 and the fixing belt 6 to each other in the press-contacting portion N, the rib is not provided in the surface of the pressing pad 12*d* provided on the overhanging extension 12*b*.

An oil absorption felt 12*e* which comprises aramid fibers as a lubricant absorption member is disposed with a predetermined gap from the elastic member portion on each of the right and left both side portions of above described elastic member portion 12*d*. In this embodiment, each of the left and right oil absorption felt 12*e* thereof is separated from the lateral end portion of the pressing pad by a 1 mm distance, and it is supported fixedly by the overhanging extension (base member) 12*b*. Designated by α is the spacing portion between the end of the oil absorption felt 12*e* and the pressing pad.

The guide member 12 is supported between the right and left side plates by engaging the projections 12*f* provided on the right and left opposite ends with the engaging portions of the right and left side plates of the unit frame, respectively. The guide member 12 functions also as a tension member, and, in this embodiment, it applies a tension of 49N (5 kgf) to the pressing belt 12.

The cover 13 is provided on the guide member 12 and is a lubricative sheet which is effective to cover a side of the guiding member 12 that is opposed to the inner side of the pressing belt 11 in order to reduce the frictional resistance between the guiding member 12 and the pressing belt 11. The coefficient of friction of the cover 13 relative to the inner surface of the pressing belt is smaller than the coefficient of friction thereof relative to the guide member 12. The cover 13 is preferably cloth made from glass fibers coated with fluororesin material, for example, or a sheet-like polyimide to which depressions and projections are provided to reduce the contact area relative to the inner surface of the pressing belt. In this embodiment, it is the latter, that is, sheet-like polyimide.

In this embodiment, the cover 13 is used, and, the guide member 12 is inserted into the inner side thereof, and then, it is fixed by screw 12*g* in the upstream portion of the guide member 12 with respect to the fixing belt rotational direction. By this, the cover 13 is provided on the guide member 12 so that the opposition surface of the guide member 12 relative to the inner surface of the pressing belt may be covered.

Figure 7:
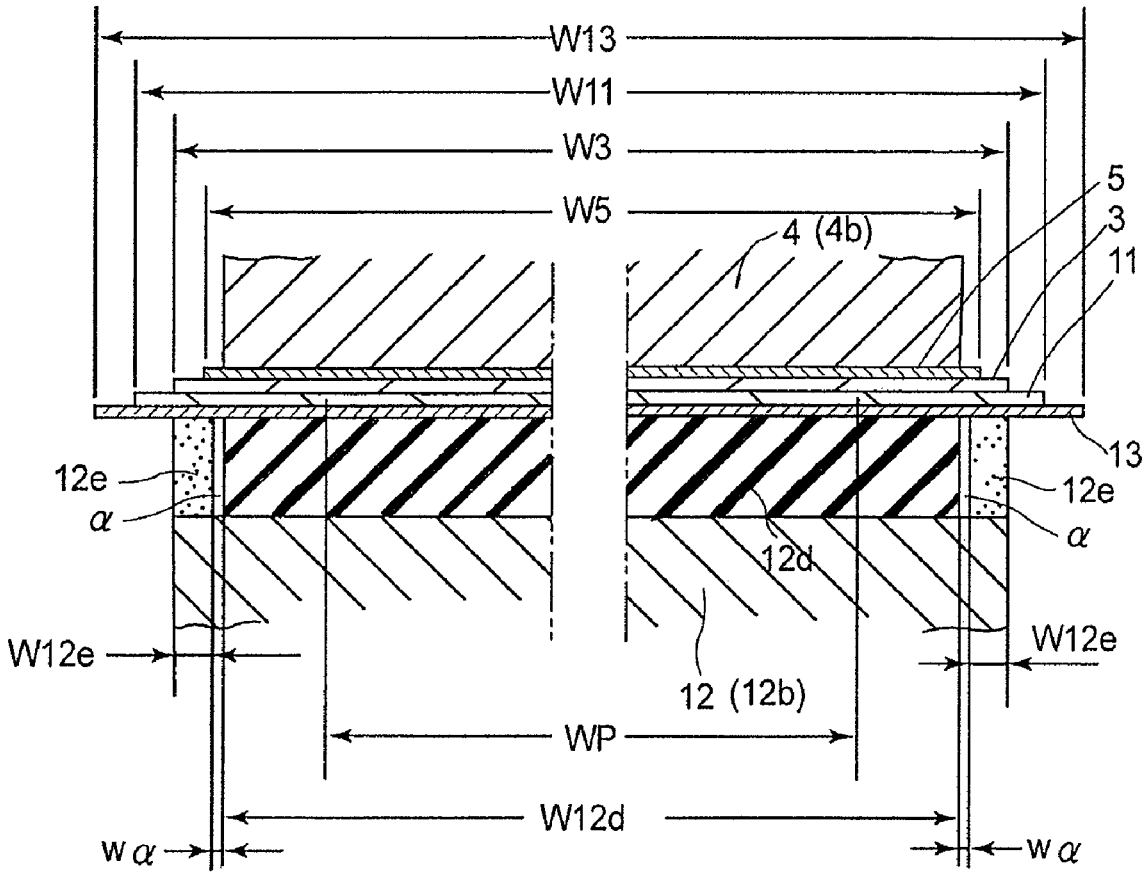
FIG. 7 is an illustration of a structure for preventing deformation of a pressing member due to a lubricant.

As shown in FIG. 7, each of the left and right oil absorption felt 12*e* is positioned inside of the right and left opposite ends of the cover 13, respectively, so that they are contacted to the inner surface of the cover 13.

The oil application roller 15 applies silicone oil as lubricant on the inner surface of the pressing belt 11 in order to reduce further the frictional resistance between the pressing belt 11 and the cover 13. The roller 15 comprises a core metal and the felt layer thereon, and the felt layer is impregnated with the silicone oil as lubricant. The roller 15 contacts the inner surface of the pressing belt 11 and is rotatably supported on the right and left side plate of the unit frame at the right and left opposite ends. The roller 15 is driven to rotate by the rotation of the pressing belt 11 and applies the proper quantity of silicone oil on the inner surface of the pressing belt 11.

7) Pressing Roller 14

In this embodiment, the inner diameter of the pressing roller 14 is 17 mm, the outer diameter thereof is 23 mm in the widthwisely central portion (the longitudinally central portion), and it is 22 mm in the opposite end portions. Thus, the roller is made from crown-shaped ferrous metal. For a similar reason to the case of above described fixing roller 5, the taper configuration is given to the outer diameter of the pressing roller 14 such that even though the pressing roller 14 bends at the time of the pressing, the width, with respect to the direction of the belt movement, of the press-contacting portion relative to the fixing roller 5, is made uniform over the longitudinal direction of the press-contacting portion.

The pressing roller 14 receives the driving force from the motor M2 controlled by the controlling circuit 100 through the drive transfer system (unshown), so that it rotates at the predetermined speed in the clockwise direction indicated by arrow in FIG. 2. By the rotation of the pressing roller 14, the pressing belt 11, stretched between the pressing roller 14 and the guide member 12, is rotated in the counterclockwise direction indicated by arrow in FIG. 2 by the friction between the surface of the pressing roller 14 and the surface of the polyimide layer 11*a* which is the inner surface layer of the pressing belt 11. With this structure, the sliding friction between the guide member 12 and the pressing belt 11 is made by the cover 13. The sliding friction between the cover 13 and the pressing belt 11 is reduced due to application of the silicone oil to the inner surface of the pressing belt by the oil application roller 15.

Figure 8:
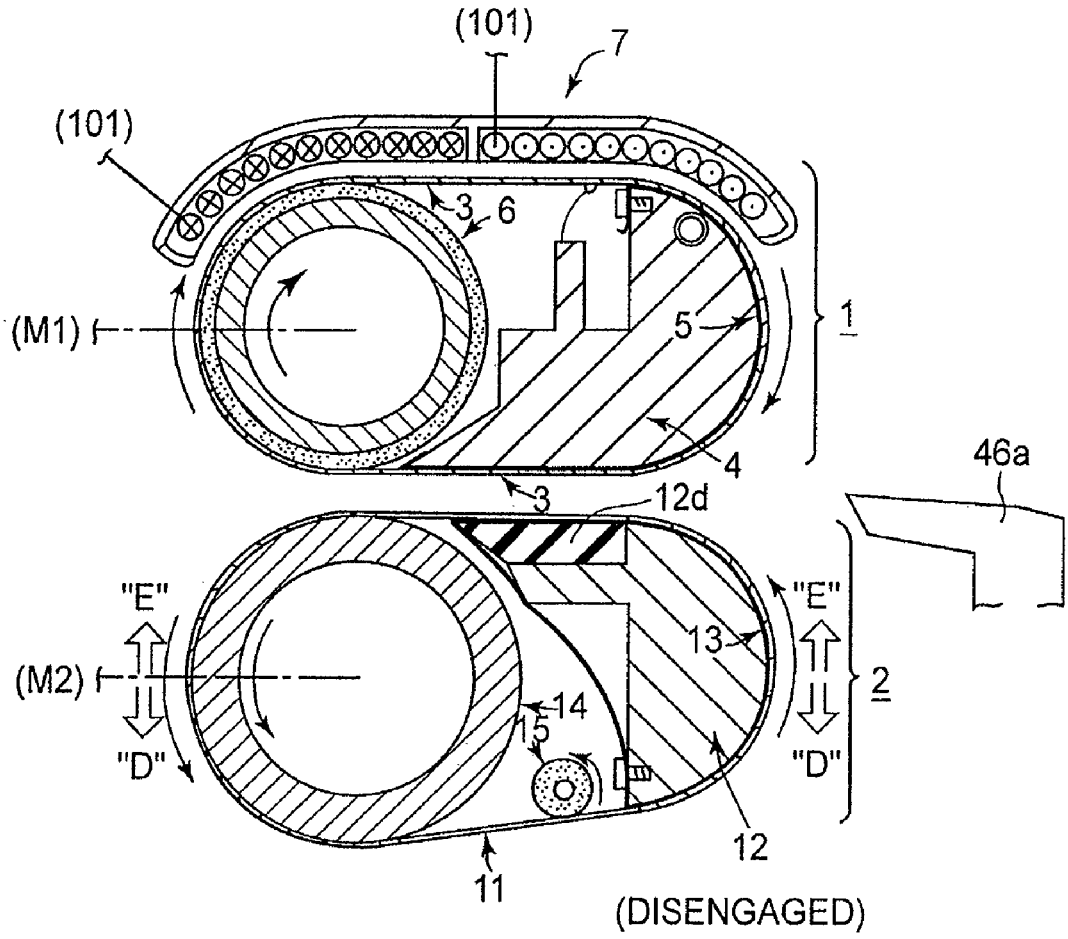
FIG. 8 illustrates a pressing belt unit in which the belt is in the state of disengagement.

The pressing belt unit 2 can be switched relative to the fixing belt unit 1 by the movement mechanism 102 controlled in the controlling circuit 100. The pressing belt unit 2 can be switched relative to the fixing belt unit 1 between a mounted state in which they are press-contacted by the predetermined pressure with each other as shown in FIG. 2, and a dismounted states in which it is spaced from the fixing belt unit 1 as shown in FIG. 8.

Although the detailed structure of the movement mechanism 102 is omitted for the sake of simplicity, the structure of the proper mechanism can be employed by the person skilled in art. For example, a pressurization spring which lifts and moves the unit 2 relative to the unit 1 and is press-contacted to a predetermined extent may be used in order to retain the mounted state. A cam member for lowering and moving the unit 2 away from the unit 1 against the pressurization spring thereof to retain the dismounted state may be used. The unit 2 is switched to the mounted state or to the dismounted state by controlling the angle of rotation of the cam member by the motor controlled in the controlling circuit 100.

The controlling circuit 100 controls the movement mechanism 102 so that the unit 2 may be retained in the mounted state relative to the unit 1 during the fixing operation. In the mounted state, the guide member 12 which is the pressing member of the unit 2 sandwiches the pressing belt 11 and the fixing belt 3, and, in this embodiment, it is pressed by 392N (40 kgf) toward the guide member 4 which is the pressing member provided in the side of the unit 1. The pressing roller 14 of the unit 2 sandwiches the pressing belt 11 and the fixing belt 3, and, in this embodiment, is pressed by 392N toward the fixing roller 6 by the side of the unit 1.

As a result, in this embodiment, the width with respect to the belt rotational direction of the press-contacting portion N between the fixing belt 3 and the pressing belt 11 is about 15 mm. The position of upper and lower rollers 6 and 14 is subjected to pressure higher than in the pair of the upper and lower guide members 4 and 12 per area of the unit. Therefore, if both of the belts 3, 11 are driven by the upper and lower rollers 6, 14, both of belts 3, 11 can be rotated stably without slippage.

Also, in the state in which the fixing belt 3 and the pressing belt 11 are rotated, the off-set moving force in the widthwise direction is comparatively small. In other words, the force which tends to shift the fixing belt 3 and the pressing belt 11 in the widthwise direction is small in consideration of the strength of each belt. For this reason, if the flange member which stops the ends of the fixing belt 3 and the pressing belt 11 is provided as the means for regulating the off-set of the belt in the widthwise direction, it is sufficient. By this, there is an advantage in that the structure of the fixing device can be simplified.

The pressing roller 14 is harder than the fixing roller 6. Therefore, a deformation of the fixing roller 6 becomes large at the exit of the press-contacting portion between the fixing belt 3 and the pressing belt 11. As a result, the fixing roller 6 deforms so greatly that self-separation of the toner image occurs, and the fixing belt 3 can separate and feed the recording material P from the fixing belt 3 satisfactory.

Figure 9:
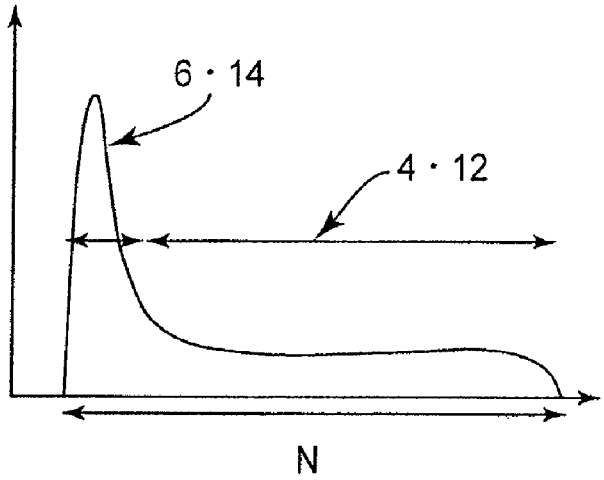
FIG. 9 is a pressure distribution drawing with respect to a sheet feeding direction of a press-contacting portion (the fixing nip).

The up-and-down guide members 4, 12 are extended to the neighborhoods of the fixing roller 6 and the pressing roller 14, respectively, and as shown in FIG. 9, there is no local void of pressure in the press-contacting portion N. If there is the portion which does not have the pressure in the press-contacting portion N, the problem that the fixing belt 3 and the recording material P are spaced, the problem that the toner image t is disturbed by the speed difference between the fixing belt 3 and the recording material P, and so on arise. According to this embodiment, the problems can be avoided.

In this embodiment, other than the time of the fixing operation, the controlling circuit 100 controls the movement mechanism 102 so that the pressing belt unit 2 may be retained in the dismounted state spaced from the fixing belt unit 1. At the time of the warming-up time of the fixing device 46, while keeping the unit 2 retained in the dismounted state, starting the motor M1 and M2 rotates the fixing belt 3 and the pressing belt 11 and electric power is supplied to the coil assembly 7 from the excitation circuit 101. In other words, heating of the fixing belt 3 is started. By this, since the heat of the fixing belt 3 does not conduct to the pressing belt 11, the warming-up time of the fixing device 46 is shortened as compared with the case where the unit 2 is the mounted state. In the case of the fixing device according to this embodiment, if 1200 W inputs to the induction heating coil 7*a* in the state where the pressing belt 11 is spaced from the fixing belt 1, the fixing belt temperature reaches 170 degrees C., which is the target temperature, in about 18 seconds.

At least at the time of the image formation execution, the controlling circuit 100 controls the movement mechanism 102 so that it may retain in the mounted state in which the unit 2 press-contacts to the unit 1 with the predetermined pressure. In the mounted state, motors M1 and M2 and the excitation circuit 101 are in the ON states, and the fixing belt 3 and the pressing belt 11 are driven. In addition, the heating control for fixing belt 3 is carried out to keep it at the predetermined temperature. In this state, the recording material P which is fed from the secondary transfer portion side and which carries the unfixed toner image t is introduced into the fixing device 46, and is guided by the guide member 46*a*. In addition, the recording material P enters the press-contacting portion N between the fixing belt 3 and the pressing belt 11. The toner image carrying surface of the recording material P faces to the surface of the fixing belt 3. By closely contacting the recording material P to the outer periphery surface of the fixing belt 3 in the press-contacting portion N, and nipping and feeding the press-contacting portion N together with the fixing belt 3, the heat of the fixing belt 3 is mainly applied and the unfixed toner image t is fixed by heat and pressure on the surface of the recording material P by the pressure of the press-contacting portion N. The self-separation is carried out by deformation of the exit portion of the press-contacting portion N of the surface of the fixing belt 3 from the outer periphery surface of the fixing belt 3, and the recording material P which passed through the press-contacting portion N is fed to the inside of the fixing device.

The fixing belt 3 and the pressing belt 11 are driven without a crease and with almost the same circumferential speeds as the feeding speed of the recording material P fed from the secondary transfer portion side. In when of according to this embodiment, the fixing belt 3 and the pressing belt 11 rotate at 300 mm/sec, which means that 70 A4 sheets are processed per minute for full-color images.

(3) Preventive Measures Against Deformation of Pressing Pad 12*d* by Lubricant In FIG. 7, W13: Width of the cover member 13 which is the lubricative sheet-like member covering the guide member 12 which in turn is the pressing member in the side of the pressing belt unit 2:

W11: Width of the pressing belt 11

W3: Width of the fixing belt 3

W5: Width of the cover member 5 which is the lubricative sheet-like member covering the guide member 4 which is the pressing member by the side of the fixing belt unit 1

W12*d*: Width of the silicone rubber plate portion 12*d* which is the pressing pad of the guide member 12

WP: The maximum sheet passing width of the recording material P which is subjected to the image formation (center-alignment feeding or one-side alignment feeding)

W12*e*: Width of the oil absorption felt 12*e* which is the lubricant absorption member disposed at the right and left opposite ends of the pressing pad 12*d*, respectively Wα: Width of the spacing portion α between the end of the pressing pad 12*d* and the oil absorption felt 12*e*

In this embodiment, these widths satisfy the following:

W13>W11>W3>W5>W12*d*>WP

The width W13 of the cover member 13 is made larger by about 20 mm than the width (W12*d*+2W12*e*+2Wα) which is a sum of the width W12*d* of the silicone rubber plate portion 12*d*, the width W12*e* of the oil absorption felt 12*e* at the side of the right and left opposite ends thereof, and the width Wα of the spacing portion α. In other words, the right and left opposite ends of the cover member 13 are projected out by about 10 mm beyond the associated oil absorption felt 12*e*, so that the left and right oil absorption felt 12*e* is positioned inside of the cover member 13, respectively, and it contacts the inner surface of the cover member 13.

With such a structure, the oil which is forced out and leaked from the opposite ends of the press-contact sliding portions between the pressing belt 11 and the cover member 13 in the press-contacting portion N in the widthwise direction, in long term use, is prevented from spreading on the cover member 13 to the pressing pad 12*d* of the guide member 12. Even if leakage oil spreads along the outer surface, the end surface, and the inner surface of the cover member 13 and then reaches the guide member 12 side inside the cover member 13, the oil is absorbed by the oil absorption felt 12*e* inside the cover member 13 before the oil reaches the pressing pad 12*d* of the guide member 12. By this, the oil is prevented from reaching the pressing pad 12*d* of the guide member 12. The oil absorption felt 12*e* is spaced from the end of the pressing pad 12*d*, so that the wetting-with-oil of the rubber plate portion 12*d* by the contact of the felt 12*e* which absorbs the oil is also prevented. Therefore, deformation due to the lubricant of the rubber plate portion 12*d* which is the pressing pad is prevented.

When the oil absorption felt 12*e* is used in this embodiment, even after fixing 200,000 sheets, the silicone oil does not reach the rubber plate portion 12*d*, and a satisfactory state is maintained.

On the other hand, in durability tests of a structure without oil absorption felt 12*e*, the silicone oil lubricant from the oil application roller 15 reached the pressing pad 12*d* when the number of A4 sheets processed reached 50,000 in the longitudinal feeding. When the number reached the 100,000 sheets, the pressing pad 12*d* swelled with silicone oil, and the volume of the portion which swelled expanded. In addition, the pressure of the press-contacting portions N increased locally, resulting in creases in the recording material.

The above described leakage oil is prevented from spreading to the upper surface of the pressing belt 11 and reaching the press-contacting portion between the pressing belt 11 and the fixing belt 3 by satisfying the width relation of W13>W11. By this, oil contamination of the recording material P nipped and fed in the press-contacting portion N is prevented.

As described in the foregoing, in this example the oil absorption felt 12*e* as the lubricant absorption member is installed in each lateral side of the pressing pad 12*d*, and the entire region of the upper surface portion of the oil absorption felt 12*e* is covered with the cover member 13. Therefore, with the structure of this example the oil absorptance thereof will not be lost at an early stage by absorbing the oil rapidly in the oil absorption felt 12*e*. As a result, the pressing pad 12*d* does not absorbing lubricant and does not swell. Therefore, the pressure of the fixing nip is maintained at a proper value for a long term. In other words, the a fixing device with the long life can be provided.

(4) Other Embodiments

1) In above described embodiment, the structure wherein the pressing belt 11 is heated with a heater can also be used.

2) Either the fixing belt 3 which is the heating rotatable member or the pressing belt 11 may be a roller member.

3) The structure of the pressing pad, oil absorption felt, the low-frictional sheet, and so on in the pressing belt side can also be employed in the fixing belt side.

4) The heater of the heating rotatable member may be replaced with heaters other than the electromagnetic induction heating type, for example, the halogen heater, an infrared lamp, and so on.

5) In the above example member a applies the oil on the inner surface of the belt. However, the oil may be provided beforehand on the inner surface of the belt, and then the oil applying member can be omitted.

6) Although the fixing device is described above as an image heating device, it may be applied to a device for carrying out temporary fixing of a toner image, the glossiness improvement device for improving the glossiness of an image by heating for the second time the toner image already fixed on the recording material, and so on.

While the invention has been described with reference to the structures disclosed herein, it is not confined to the details set forth, and this application is intended to cover such modification or changes as may come within the purposes of the improvements or the scope of the following claims.

This application claims priority from Japanese Patent Application No. 098919/2006 filed Mar. 31, 2006, which is hereby incorporated by reference.

What is claimed is:

1. An image heating apparatus comprising:

an endless belt for heating an image on a recording material in a nip;

a pressing pad for pressing said belt from an inner surface thereof in said nip;

a sheet-like member, provided to cover said pressing pad, for sliding movement relative to said belt;

a lubricant absorbing member for suppressing swelling of said pressing pad by absorbing a lubricant applied on an inner surface of said belt, wherein widthwise ends of said sheet-like member are outside widthwise ends of said belt, and said lubricant absorbing member is covered by said sheet-like member, and wherein said lubricant absorbing member is disposed inside of the widthwise ends of said belt with respect to a widthwise direction of said belt.

2. An apparatus according to claim 1, wherein said pressing pad includes a base member and an elastic member provided on said base member, wherein said lubricant absorbing member is disposed on said base member with a gap between itself and said elastic member.

3. An apparatus according to claim 1, wherein said lubricant absorbing member comprises felt.

4. An apparatus according to claim 1, wherein said belt is contactable to a surface of the recording material which is opposite a surface thereof which carries the image.

5. An image heating apparatus comprising:

an endless belt for heating an image on a recording material in a nip;

a pressing pad for pressing said belt from an inner surface thereof in said nip;

a sheet-like member, provided to cover said pressing pad, for sliding movement relative to said belt;

a lubricant absorbing member, provided at a lateral end of said pressing pad, for absorbing a lubricant applied on an inner surface of said belt, wherein widthwise ends of said sheet-like member are outside widthwise ends of said belt, and said lubricant absorbing member is covered by said sheet-like member, and wherein said lubricant absorbing member is disposed inside of the widthwise ends of said belt with respect to a widthwise direction of said belt.

6. An apparatus according to claim 5, wherein said pressing pad includes a base member and a rubber portion provided on said base member, and wherein said lubricant absorbing member is disposed on said base member with a gap between itself and said rubber portion.

7. An apparatus according to claim 6, wherein said lubricant absorbing member is provided at each of the lateral ends.

8. An apparatus according to claim 5, wherein said lubricant absorbing member comprises felt.

9. An apparatus according to claim 5, wherein said belt is contactable to a surface of the recording material which is opposite a surface thereof which carries the image.

10. An apparatus according to claim 1, wherein said belt is rotatable along an endless path that is perpendicular to a widthwise direction of said belt.

11. An apparatus according to claim 5, wherein said belt is rotatable along an endless path that is perpendicular to a widthwise direction of said belt.

* * * * *